US009694963B1

(12) United States Patent
Rao

(10) Patent No.: US 9,694,963 B1
(45) Date of Patent: Jul. 4, 2017

(54) DISPOSABLE INSULATING CUP SLEEVE

(71) Applicant: RAO INNOVATIONS LLC., Pacific Palisades, CA (US)

(72) Inventor: Vijendra Rao, Pacific Palisades, CA (US)

(73) Assignee: RAO INNOVATIONS LLC, Pacific Palisades, CA (US)

( * ) Notice: Subject to any disclaimer, the term of this patent is extended or adjusted under 35 U.S.C. 154(b) by 0 days.

(21) Appl. No.: 15/130,277

(22) Filed: Apr. 15, 2016

Related U.S. Application Data

(60) Provisional application No. 62/272,760, filed on Dec. 30, 2015.

(51) Int. Cl.
*B65D 81/38* (2006.01)
*A47G 19/22* (2006.01)
*B65D 25/20* (2006.01)

(52) U.S. Cl.
CPC ..... *B65D 81/3876* (2013.01); *A47G 19/2205* (2013.01); *B65D 25/20* (2013.01)

(58) Field of Classification Search
CPC B65D 81/38; B65D 81/3841; B65D 81/3865; B65D 81/3869; B65D 81/3874; B65D 81/3876; B65D 3/04; B65D 3/22; B65D 3/28; B65D 23/0885; B65D 23/0892; B65D 25/28; B65D 25/2814; B65D 25/2897; B65D 65/403; A47G 23/0216; Y10S 220/09; Y10S 493/907
USPC ..... 229/4.5, 5.84, 400, 403, 939; 220/62, 220/62.12, 62.2, 592.2, 737–739, 753, 220/903, DIG. 9; 215/12.1, 13.1
See application file for complete search history.

(56) References Cited

U.S. PATENT DOCUMENTS 2,794,545 A * 6/1957 Olson ..... B65D 3/24 206/217
5,469,983 A * 11/1995 Yawata ..... B65D 25/2814 220/739
7,922,031 B1 * 4/2011 Prince ..... B65D 81/3876 220/737
8,210,392 B2 * 7/2012 Kang ..... B65D 25/2847 220/737
8,286,824 B2 * 10/2012 Ikeda ..... B65D 81/3876 220/739
D670,542 S * 11/2012 Lee ..... D7/622
8,523,008 B2 * 9/2013 Kim ..... B65D 81/3876 220/738

(Continued)

*Primary Examiner* — Chun Cheung
*Assistant Examiner* — Brijesh V. Patel
(74) *Attorney, Agent, or Firm* — Martin & Ferraro, LLP

(57) ABSTRACT

An apparatus used for preventing heat transfer from a cup holding a hot beverage to the hand of a user contains a perimetric sleeve and a plurality of insulation units. The plurality of insulation units is connected to the perimetric sleeve providing thicker holding area for the user. The plurality of insulation units, which can vary in shape and size, is positioned in between a first edge of the perimetric sleeve and a second edge of the perimetric sleeve. Different mechanisms, such as a plurality of vents, can be integrated into each of the plurality of insulation units in order to improve the heat transfer process from the cup to the atmosphere. Moreover, the plurality of insulation units can also be connected to the perimetric sleeve in different methods to improve the overall efficiency of the apparatus.

4 Claims, 18 Drawing Sheets

(56) References Cited

U.S. PATENT DOCUMENTS

| | | | | |
|---|---|---|---|---|
| 8,727,296 | B1 * | 5/2014 | Dyer | A47G 19/08 220/739 |
| 8,887,945 | B2 * | 11/2014 | Kao | A47G 19/2205 206/218 |
| D753,959 | S * | 4/2016 | Bremer | D7/625 |
| 2002/0158074 | A1 * | 10/2002 | Yawata | B65D 25/28 220/592.2 |
| 2009/0272753 | A1 * | 11/2009 | Rebelak, Sr | B65D 65/04 220/737 |
| 2010/0224641 | A1 * | 9/2010 | Hanel | B65D 81/3876 220/737 |
| 2011/0114657 | A1 * | 5/2011 | Nygaard | B65D 23/12 220/738 |

* cited by examiner

DISPOSABLE INSULATING CUP SLEEVE

The current application claims a priority to the U.S. Provisional Patent application Ser. No. 62/272,760 filed on Dec. 30, 2015.

FIELD OF THE INVENTION

The present invention relates generally to the field of beverage sleeves. More specifically, the present invention introduces a disposable cup sleeve which is comparatively efficient compared to traditional cup sleeves which provide minimum protection to the user. Moreover, the effective design of the present invention provides better insulation.

BACKGROUND OF THE INVENTION

Coffee mugs, travel mugs, and disposable cups are used when carrying a beverage from one place to another. The overall build and material of the mugs enable the user to carry both cold and hot beverages. Similarly, the disposable cups can also be used to carry cold beverages. However, the build and material of the existing disposable cups require the user to take additional measures to protect the hands when carrying hot beverages. Even though the existing cup sleeves are efficient when holding mildly warm beverages, the cup sleeves might not be as effective when holding extremely hot beverages.

The lack of protection to the hands of the user is the most common disadvantage with the existing cup sleeves. More specifically, the minimal thickness in the existing cup sleeves result in the heat transferring from the cup towards the hand of the user. In order to address the issue, users generally use multiple cup sleeves to protect the fingers holding the cup. Even though the use of multiple sleeves is effective to some extent, the overall bulky structure resulting from multiple sleeves can be a burden when carrying a hot beverage in the disposable cup. The increased circumference due to the use of multiple sleeves also limits the use of cup holders which are designed according to pre-determined values.

Another disadvantage with the existing cup sleeves is the lack of holding area. Since only a limited surface area is provided to position the fingers, the user has limited hand movement. When the disposable cup is filled with a considerable amount of the hot beverage, the limited holding area is especially disadvantageous since the entire weight of the disposable cup and hot beverage is held at the coffee sleeve.

The objective of the present invention is to address the aforementioned issues. The present invention eliminates the need to have multiple sleeves to protect the hand of the user against the hot beverage. Moreover, the present invention provides more surface area to hold the cup carrying the hot beverage so that the user can handle the disposable cup. Therefore, by utilizing the present invention, the user is allowed to carry the hot beverage as preferred and also protect the hand against the heat from the hot beverage.

DETAIL DESCRIPTIONS OF THE INVENTION

All illustrations of the drawings are for the purpose of describing selected versions of the present invention and are not intended to limit the scope of the present invention.

The present invention introduces a modified cup sleeve that is beneficial when carrying a hot beverage. In particular, the present invention is a disposable cup sleeve that is used to avoid burns and other related injuries that can result from holding hot beverages. By utilizing the present invention, difficulties in holding a hot beverage can be avoided and the user can carry the hot beverage as preferred.

Figure 1:
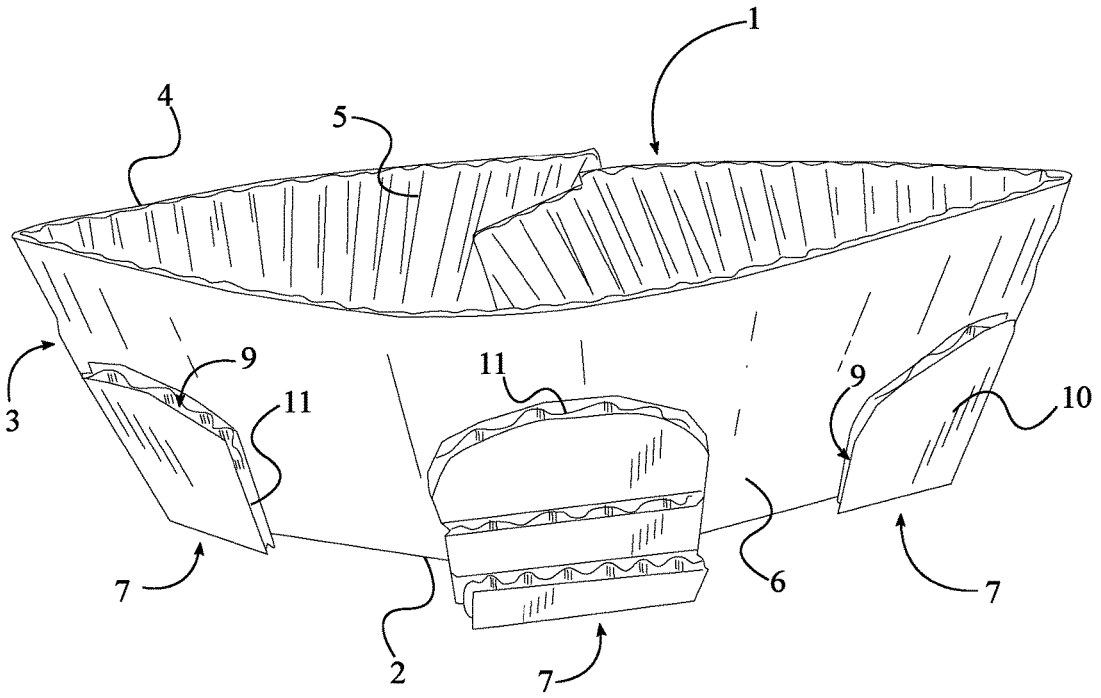
FIG. 1 is a perspective view of the perimetric sleeve and the plurality of insulation units.
Figure 2:
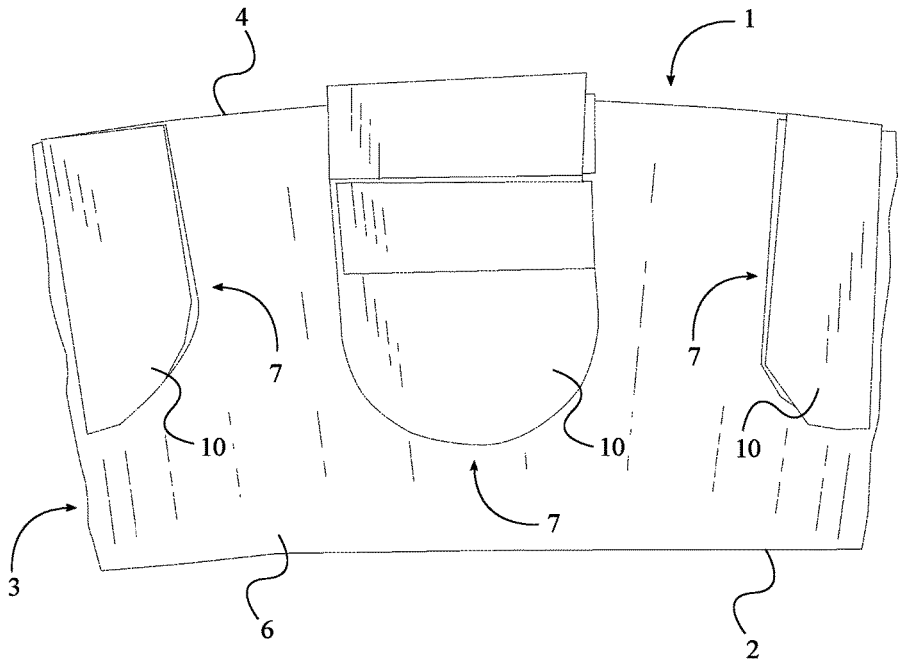
FIG. 2 is a side view of the perimetric sleeve and the plurality of insulation units.
Figure 3:
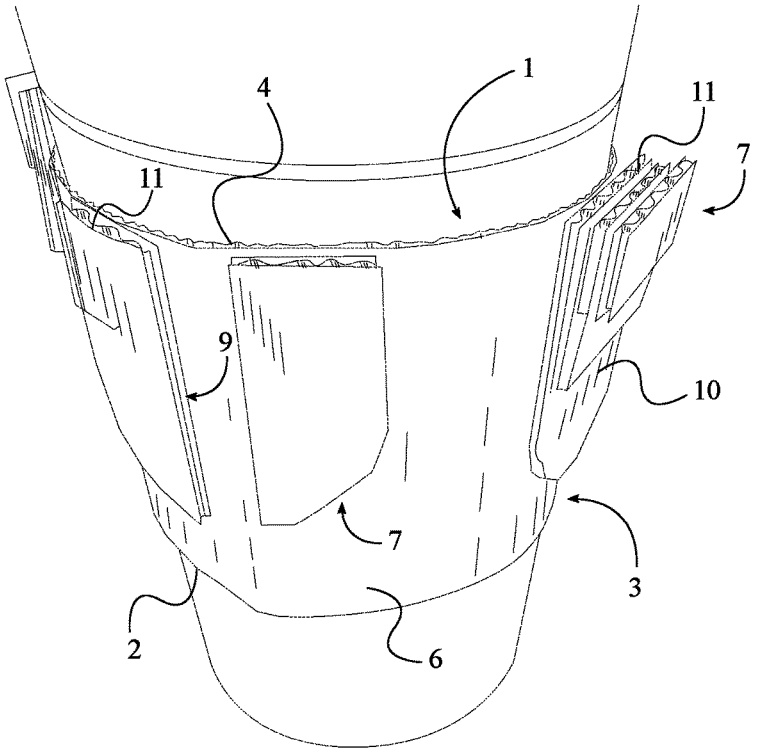
FIG. 3 is a perspective view of the present invention being used on a cup.
Figure 4:
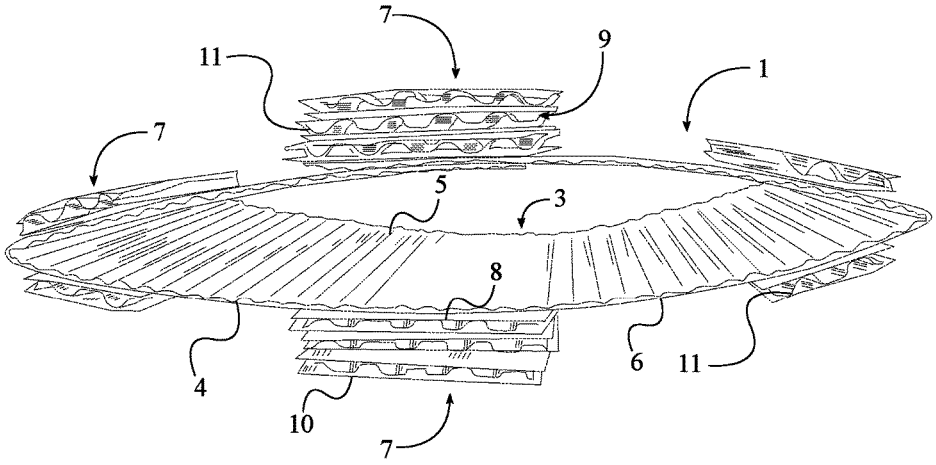
FIG. 4 is a top view of the present invention.

The present invention comprises a perimetric sleeve 1 and a plurality of insulation units 7 as seen in FIGS. 1-8. The perimetric sleeve 1 is appropriately shaped and sized to fit around a standard cup. In particular, the perimetric sleeve 1 is ring-shaped and is made of a flexible lightweight material to fit around the cup which can be, but is not limited to, a disposable cup. The perimetric sleeve 1 comprises a first edge 2, a body 3, and a second edge 4. The distance from the first edge 2 to the second edge 2 determines the width of the body 3. The body 3 is tapered from the first edge 2 to the second edge 4 such that the perimetric sleeve 1 can comfortably fit around the cup. The plurality of insulation units 7 is used to provide thicker holding area to the user holding the cup with a hot beverage within the cup. In order to do so, the plurality of insulation units 7 is connected to the perimetric sleeve 1. The plurality of insulation units 7 can be removably attached or permanently fixed to the perimetric sleeve 1. As seen in FIG. 4, the plurality of insulation units 7 is equidistantly distributed along the body 3 and is appropriately sized to be positioned in between the first edge 2 and the second edge 4. However, the positioning of the plurality of insulation units 7 can change in other embodiments of the present invention. Each of the plurality of insulation units 7 comprises a first face 8, an insulating body 9, and a second face 10. The first face 8 and the second face 10 are positioned opposite to each other across the insulating body 9. The first face 8 and the second face 10 are sufficiently sized to fit in between the first edge 2 and the second edge 4. On the other hand, the insulating body 9 has a thickness sufficient to eliminate heat transfer and also provide a comfortable grip to the user.

Figure 5:
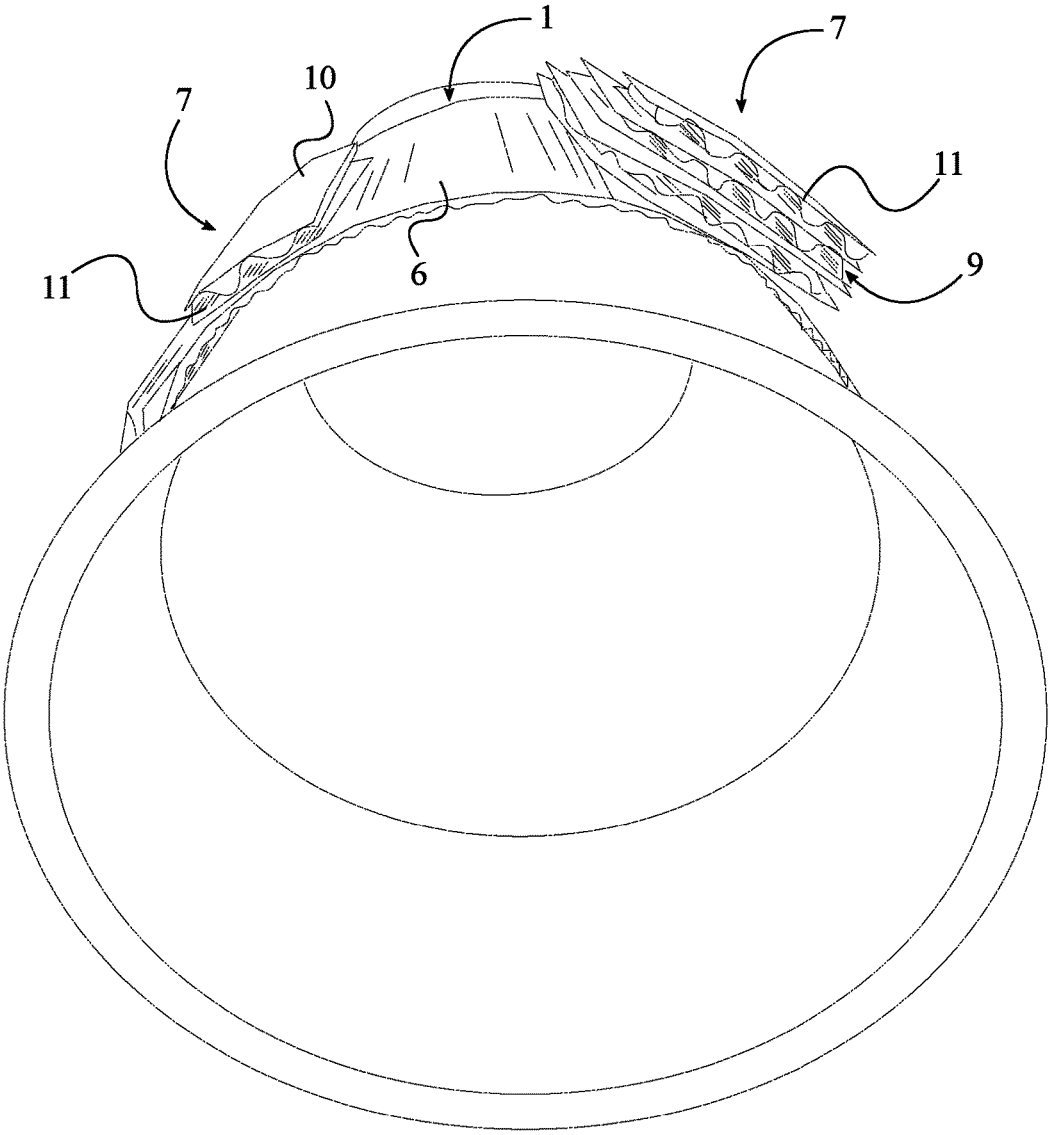
FIG. 5 is a top perspective view of the present invention being used on a cup.
Figure 6:
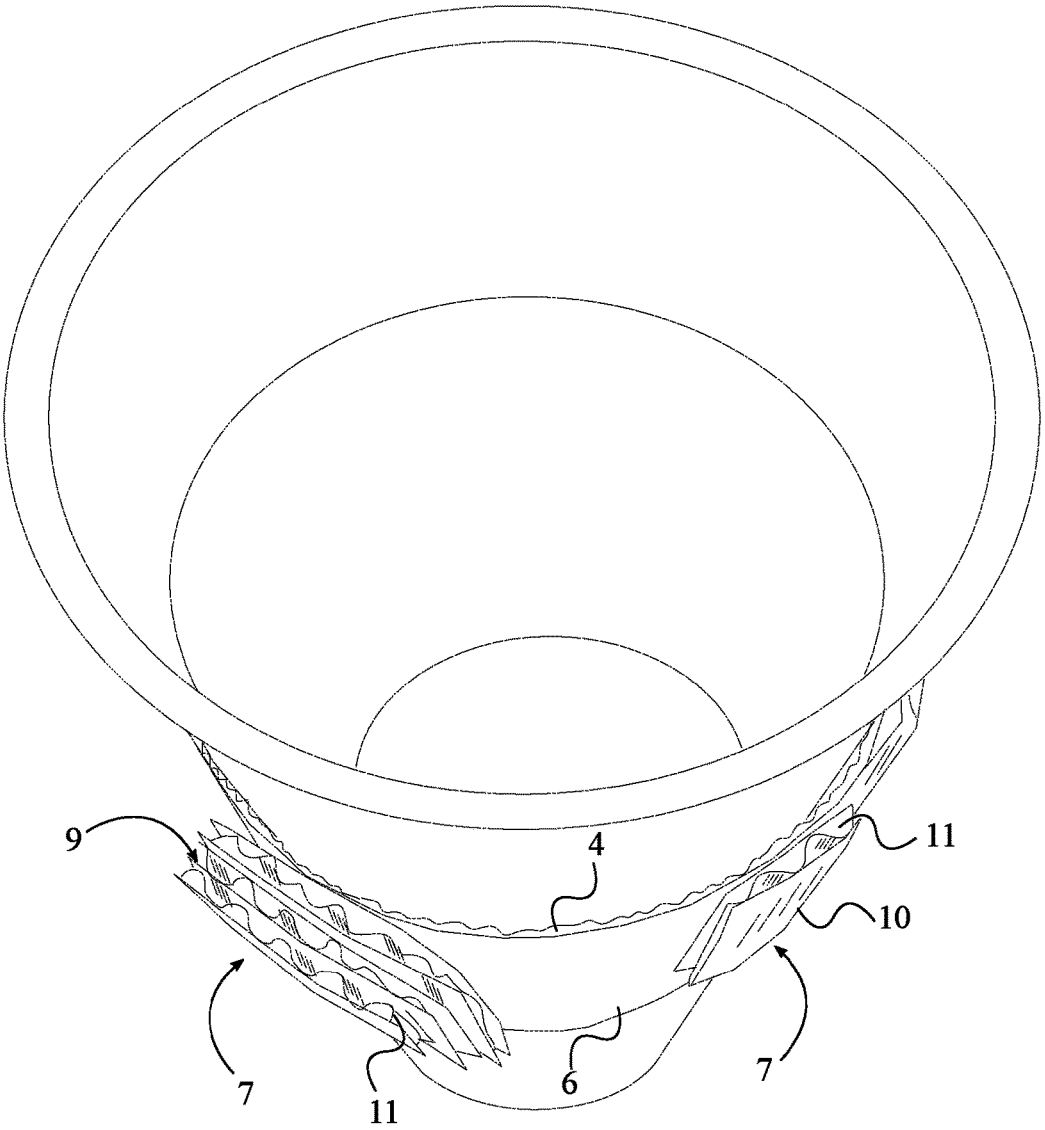
FIG. 6 is another top perspective view of the present invention being used on a cup.
Figure 7:
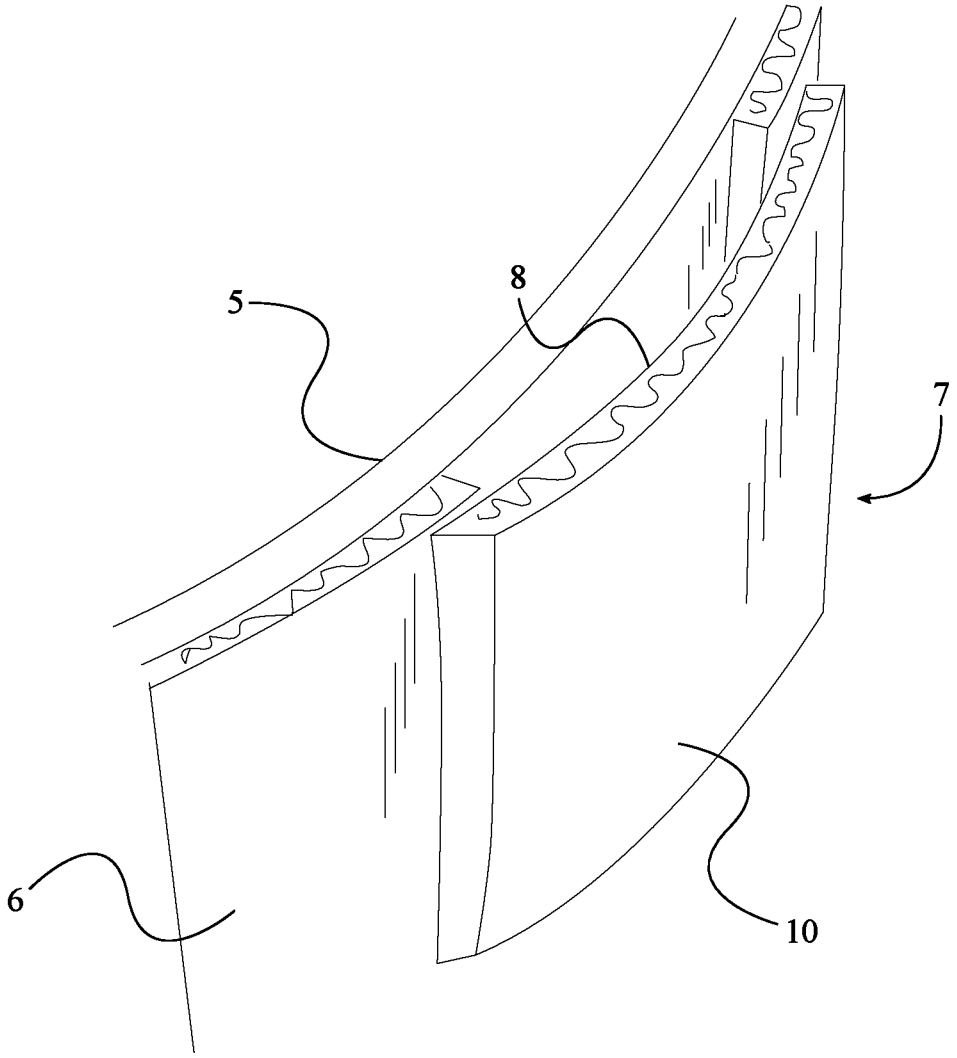
FIG. 7 is an illustration of one insulation unit of the plurality of insulation units being used along with the perimetric sleeve.
Figure 8:
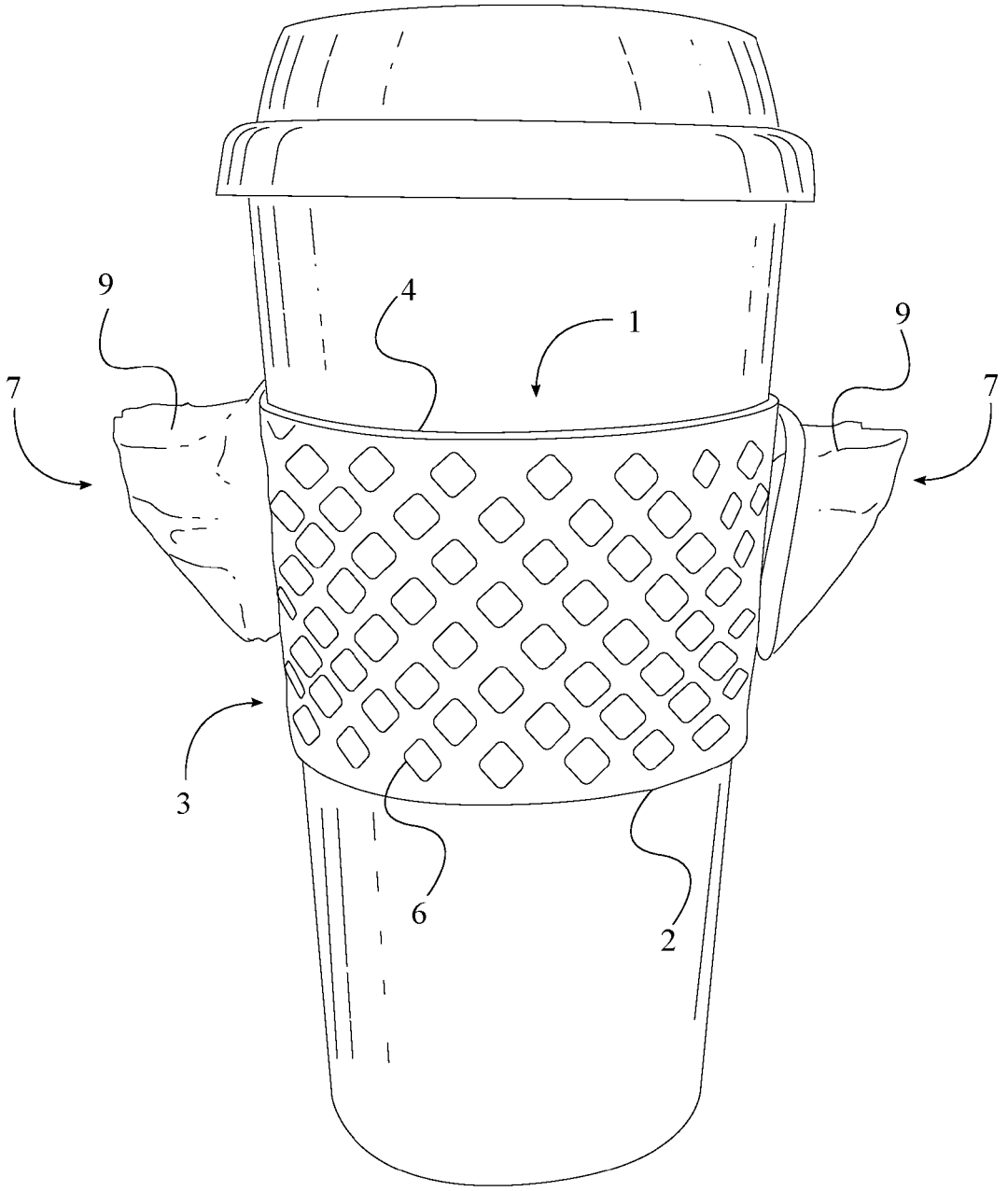
FIG. 8 is a side view of the present invention being used on a cup, wherein the outer surface of the perimetric sleeve is textured.

As seen in FIGS. 3-5, the present invention utilizes a plurality of vents 11 in order to create an efficient heat transfer process from the hot beverage to the atmosphere. In order to do so, the plurality of vents 11 traverses through the insulating body 9 of each of the plurality of insulation units 7. The plurality of vents 11 allows the heat to pass through the plurality of insulation units 7 at a faster rate allowing the user to comfortably hold the hot beverage for an extended time period. In other words, the plurality of vents 11 minimizes the heat reaching the fingers of the user. In addition to being positioned in between the first face 8 and the second face 10, the plurality of vents 11 can also be positioned along the first face 8 and the second face 10. Different positioning and different designs of the plurality of vents 11 can help create different heat transfer rates.

Figure 9:
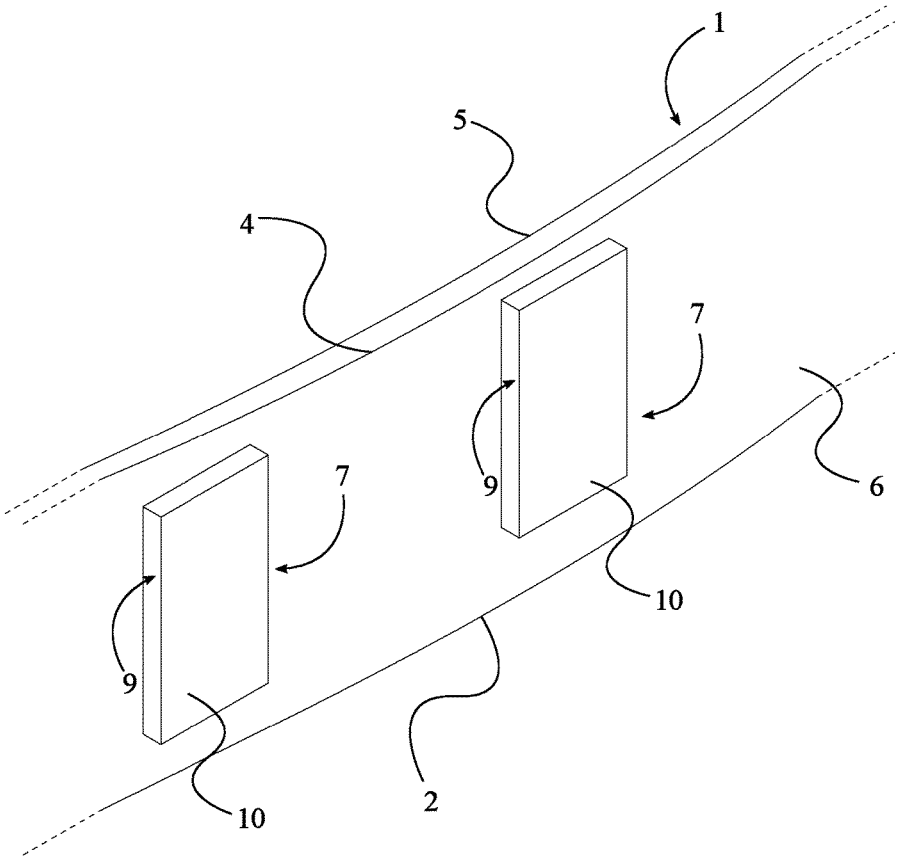
FIG. 9 is a perspective view of the plurality of insulation units being positioned within the plurality of receiving slots.
Figure 10:
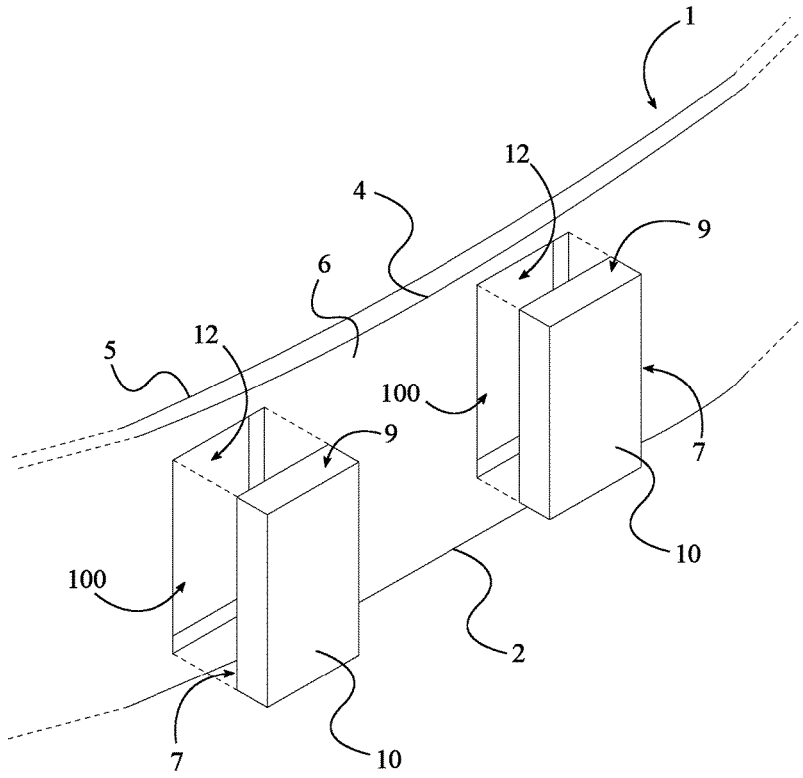
FIG. 10 is an exploded view of the plurality of insulation units and the plurality of receiving slots.

In another embodiment, the present invention comprises a plurality of receiving slots 12 as seen in FIG. 9 and FIG. 10. The plurality of receiving slots 12 is used to position the plurality of insulation units 7 such that the plurality of insulation units 7 lies flush against the cup the present invention is being used on. In order to do so, an inner surface 5 and an outer surface 6 of the perimetric sleeve 1 are used. The body 3 extends from the inner surface 5 to the outer surface 6 determining the thickness of the perimetric sleeve 1. The plurality of receiving slots 12 traverses through the body 3. Each of the plurality of insulation units 7 is positioned within a corresponding slot 100 from the plurality of receiving slots 12. When the plurality of insulation units 7 is positioned within the plurality of receiving slots 12, the first face 8 of each of the plurality of insulation units 7 is positioned adjacent to the inner surface 5. On the other hand, the second face 10 of each of the plurality of insulation units 7 extends from the outer surface 6. The positioning of the plurality of insulation units 7 within the plurality of receiving slots 12 reduces the overall diameter when the present invention is used on a cup. Even though the plurality of insulation units 7 is positioned within the plurality of receiving slots 12 in this embodiment, the plurality of insulation units 7 can also be positioned within the plurality of receiving slots 12 with another mechanism such as a hinge mechanism.

Figure 11:
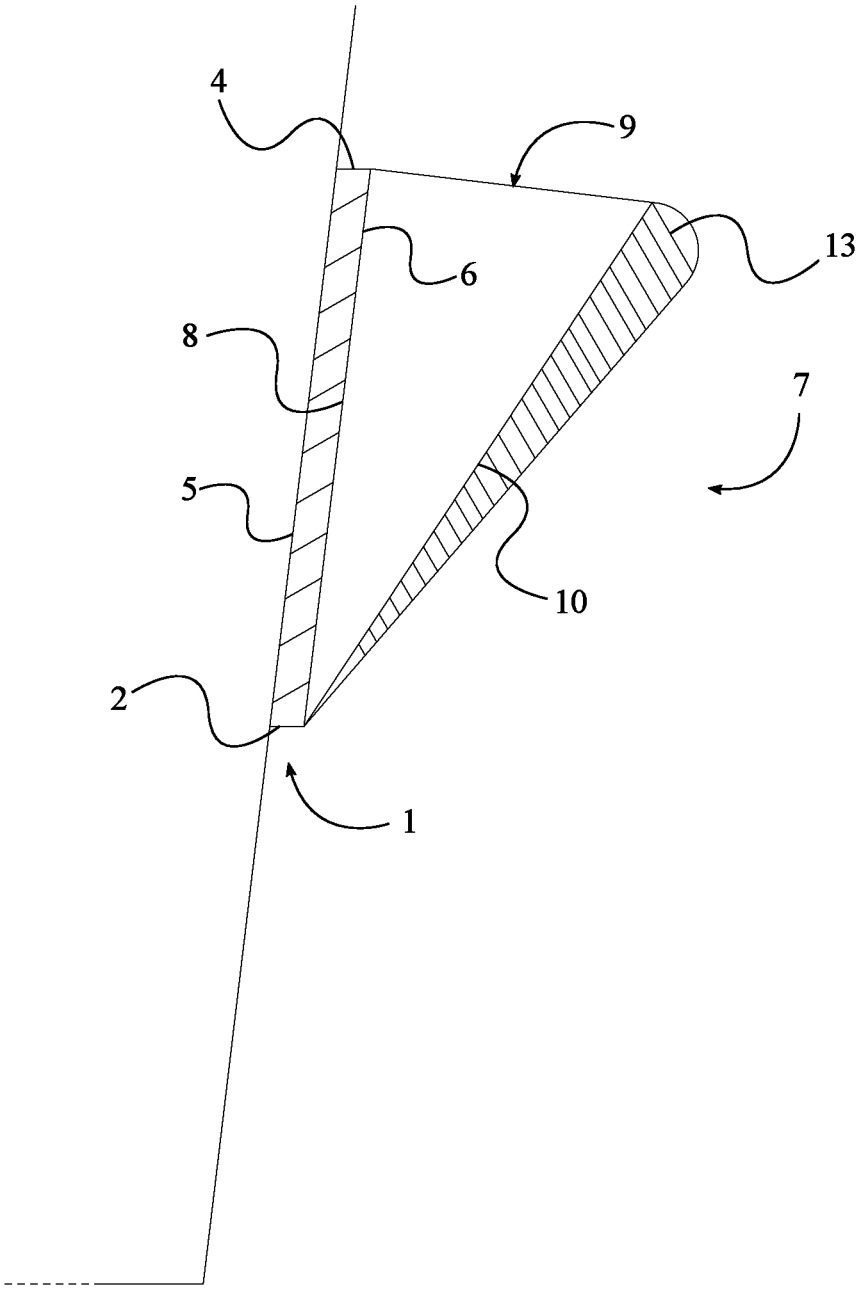
FIG. 11 is a cross sectional view of the external fold on one insulation unit of the plurality of insulation units.

As mentioned before the plurality of insulation units 7 can vary in size and shape in different embodiments of the present invention. In one embodiment of the present invention, each of the plurality of insulation units 7 can be wedge-shaped as shown in FIG. 11. When each of the plurality of insulation units 7 is wedge-shaped, the present invention comprises an external fold 13 which extends from the second face 10. In order to extend from the second face 10, the external fold 13 is adjacently connected to the second face 10.

Figure 12:
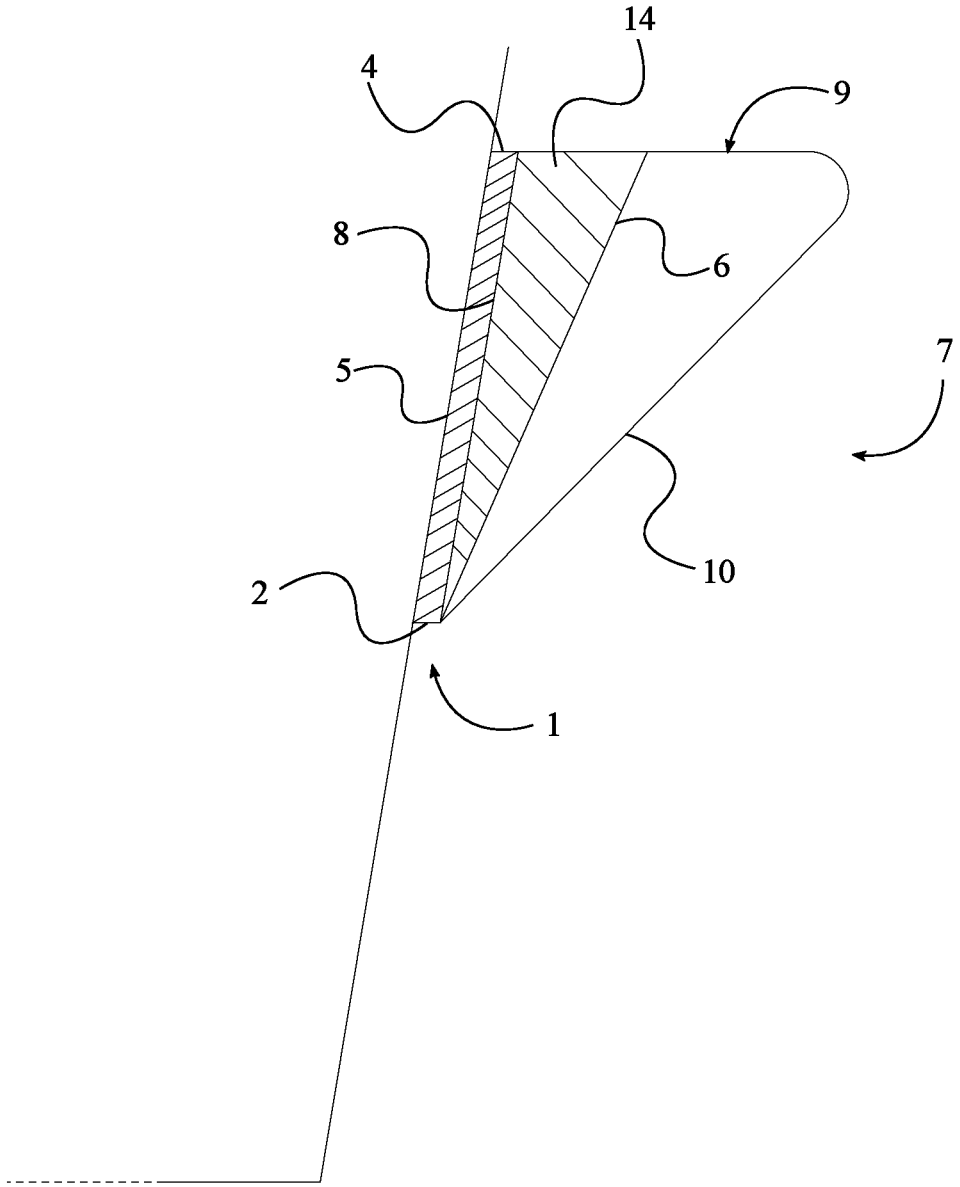
FIG. 12 is a cross sectional view of the internal fold on one insulation unit of the plurality of insulation units.

In another embodiment of the present invention, each of the plurality of insulation units 7 can be triangular in shape as seen in FIG. 12. When each of the plurality of insulation units 7 is triangular in shape, the present invention comprises an internal fold 14 which extends from the first face 8. More specifically, the internal fold 14 is adjacently connected to the first face 8.

Figure 13:
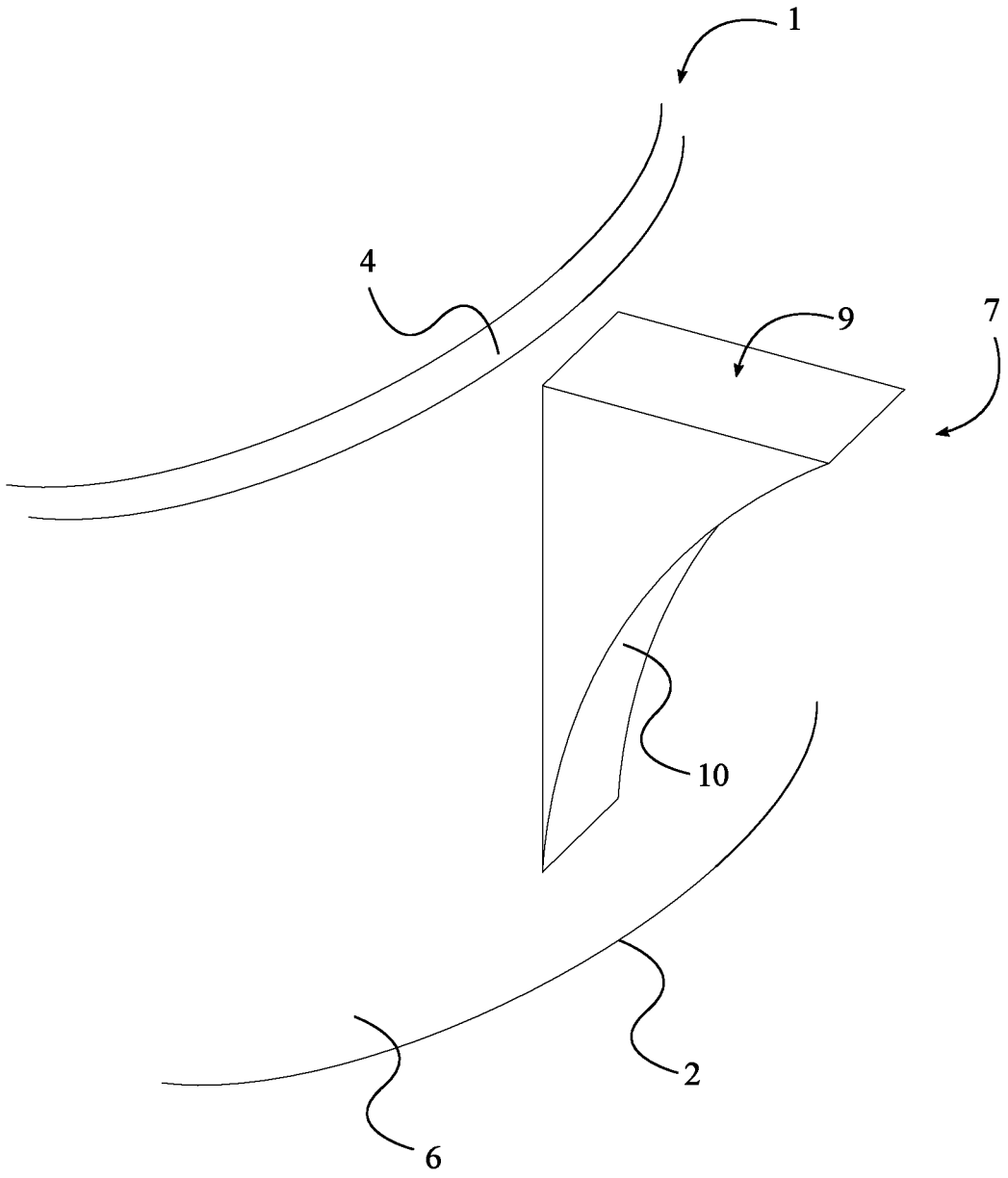
FIG. 13 is a perspective view of the present invention, wherein a second face of the plurality of insulation units is concave.
Figure 14:
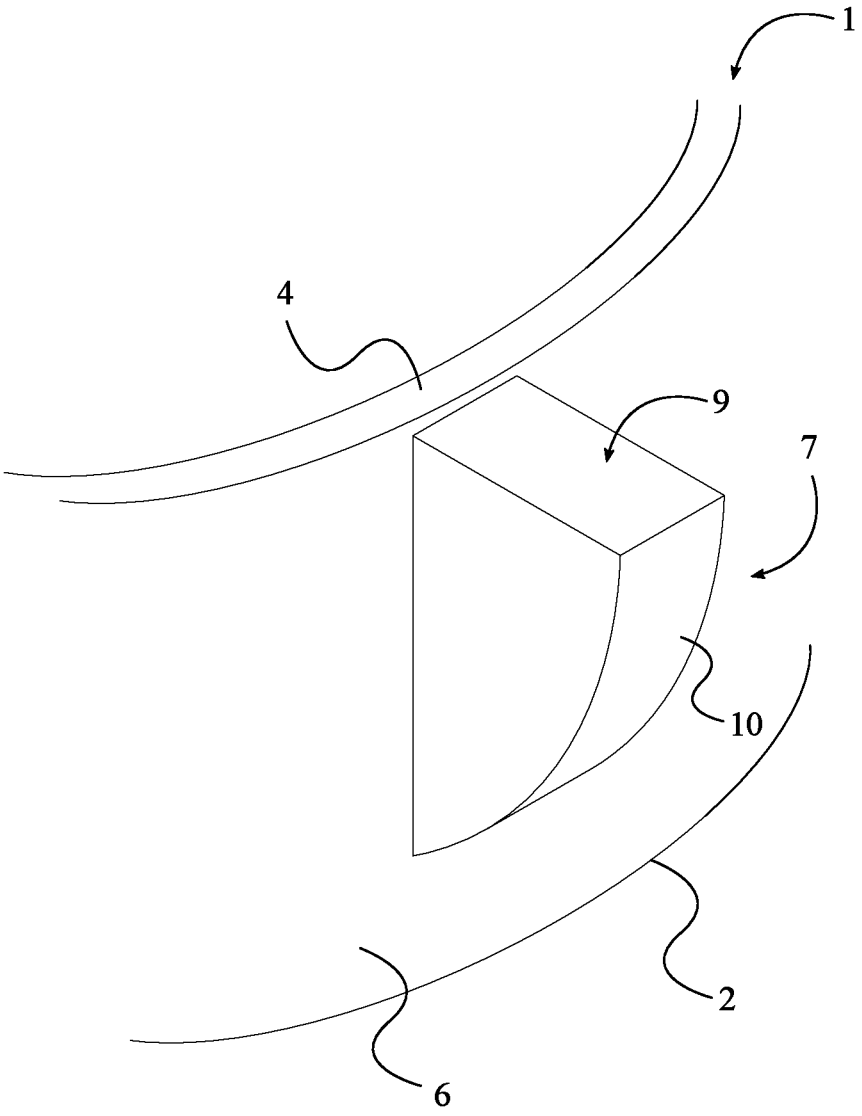
FIG. 14 is a perspective view of the present invention, wherein a second face of the plurality of insulation units is convex.

In different embodiments of the present invention, the plurality of insulation units 7 can also be differently shaped so that the user can comfortably position the fingers. In particular, the second face 10 of each of the plurality of insulation units 7 can be convex as seen in FIG. 14. In another embodiment of the present invention, the second face 10 of each of the plurality of insulation units 7 can be concave as shown in FIG. 13. The convex shape and the concave shape allows the user to wrap the fingers around each of the plurality of insulation units 7 comfortably. Resultantly, the user can maintain a firm grip on the cup with the hot beverage. The plurality of insulation units 7 can also be textured to provide a better gripping surface for the user.

Figure 15:
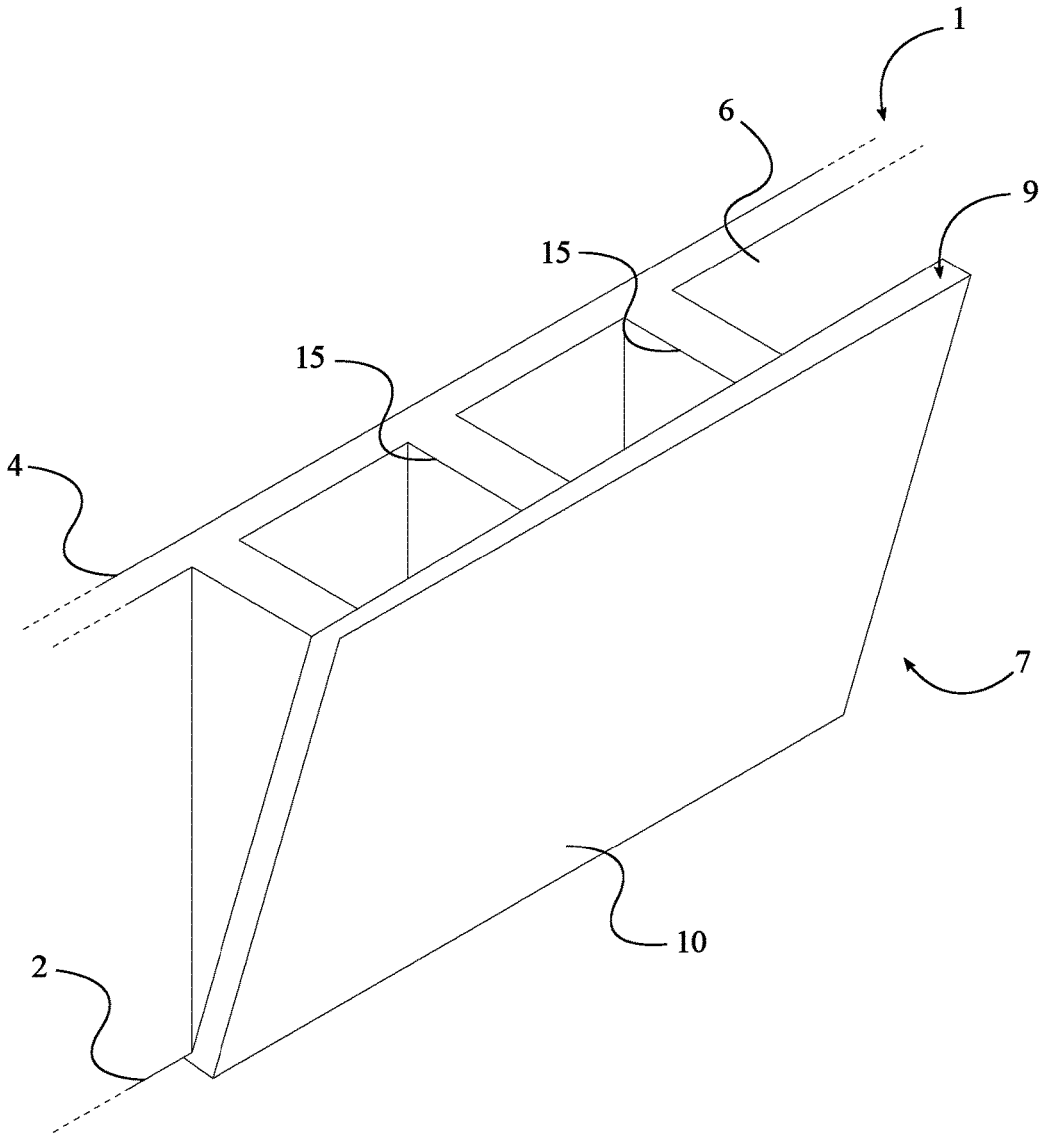
FIG. 15 is a perspective view of the present invention, wherein one insulation unit of the plurality of insulation units is supported by a plurality of hinges.

The present invention can also be designed so that the cups can be stacked upon each other even when the present invention is being used. In order to do so, the present invention comprises a plurality of hinges 15; the plurality of hinges 15 being connected in between the outer surface 6 and the first face 8. Therefore, when the need for stacking occurs, the plurality of hinges 15 is collapsed such that the plurality of insulation units 7 lies flush against the outer surface 6. The use of the plurality of hinges 15 is illustrated in FIG. 15.

Figure 16:
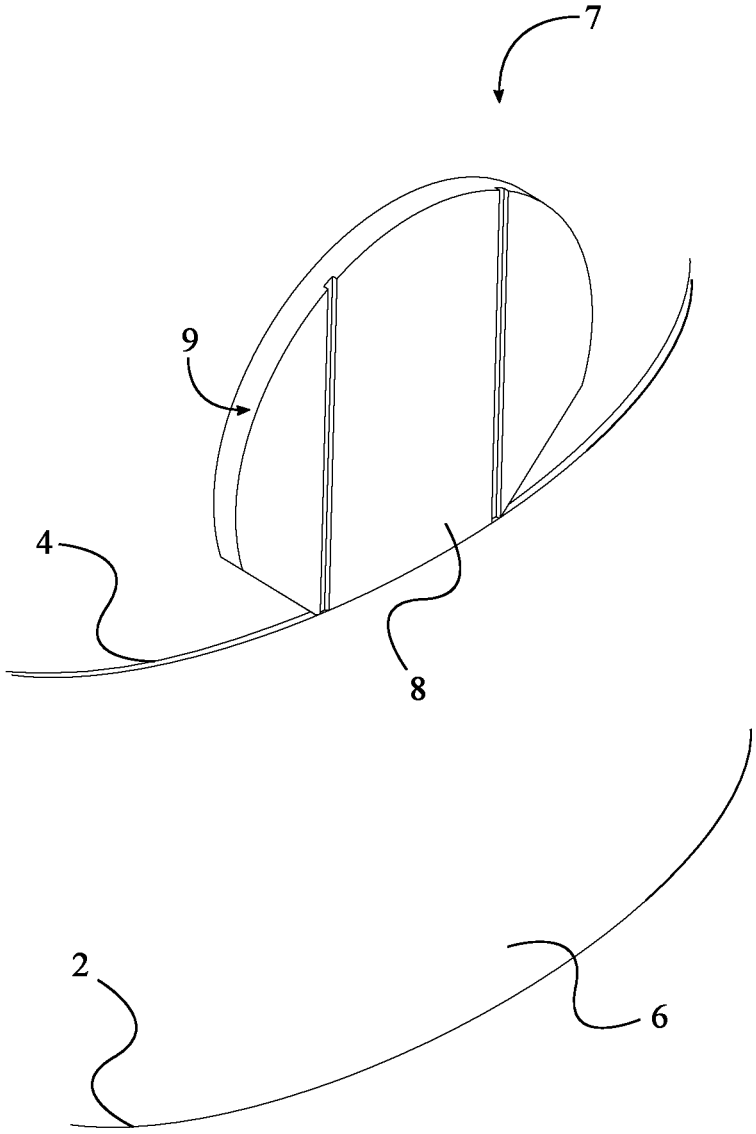
FIG. 16 is a perspective view of one insulation unit of the plurality of insulation units extending from the second edge.
Figure 17:
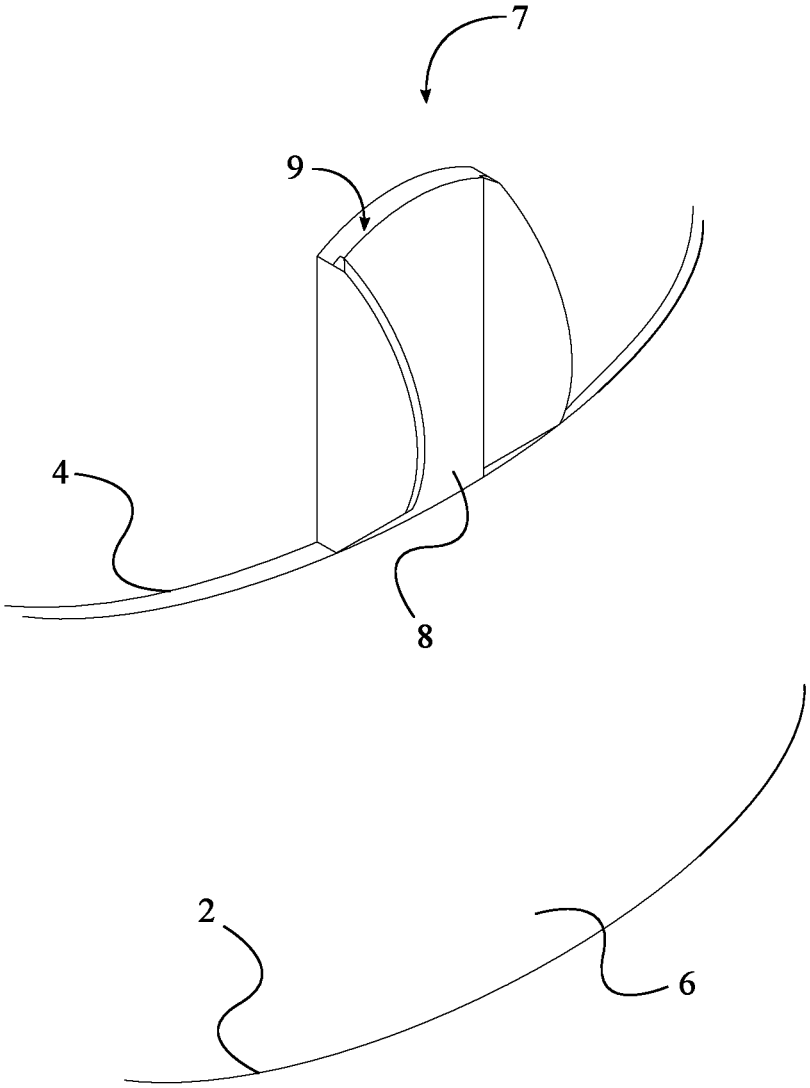
FIG. 17 is another perspective view of one insulation unit of the plurality of insulation units extending from the second edge.
Figure 18:
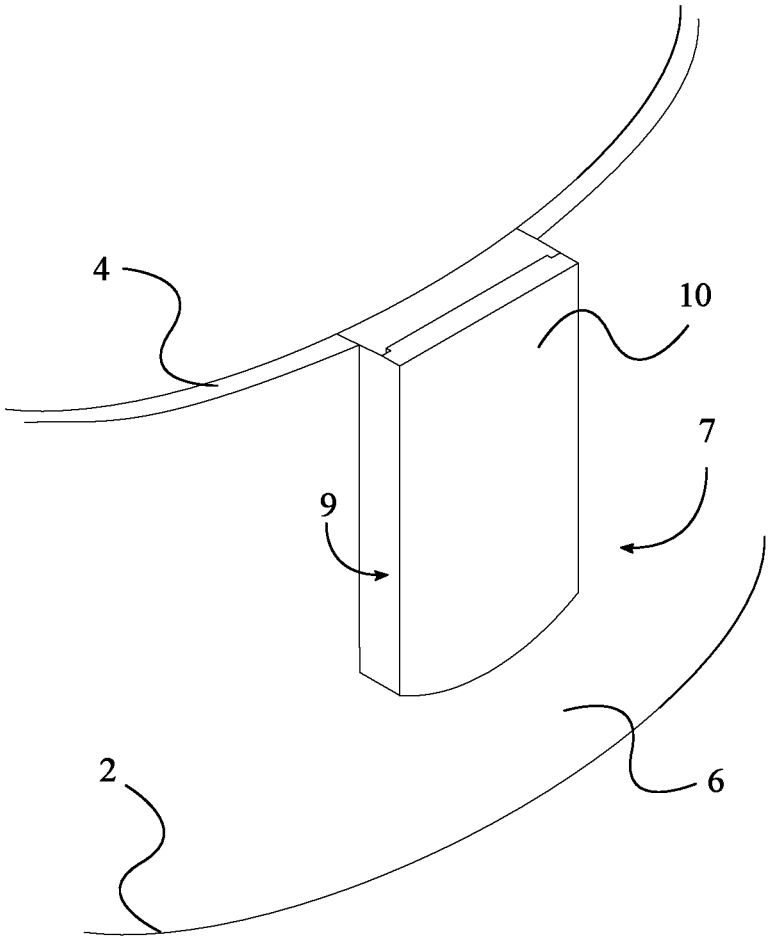
FIG. 18 is a perspective view of one insulation unit of the plurality of insulation units being folded onto the body of the perimetric sleeve.

As illustrated in FIGS. 16-18, in another embodiment of the present invention, the plurality of insulation units 7 can extend from the second edge 4. When the plurality of insulation units 7 need to be used, the user folds each of the plurality insulation units 7 as shown in FIG. 18. In the folded configuration, each of the plurality of insulation units 7 lies flush against the outer surface 6. As a result, the user is provided with additional surface area to position the fingers.

When utilizing the present invention, the following process flow is generally followed. Initially, the disposable cup or similar cup is positioned within the perimetric sleeve 1. When the perimetric sleeve 1 is snugly fit around the disposable cup, the user can grab the disposable cup by placing the fingers on the plurality of insulation units 7. If the need to stack cups occurs, the plurality of insulation units 7 is pushed towards the perimetric sleeve 1. By doing so, the plurality of hinges 15 collapses onto the body 3 such that the disposable cups can be stacked even when the present invention is being used. In different embodiments of the present invention, the perimetric sleeve 1 and the plurality of insulation units 7 can include logos and other comparable material for marketing purposes. If the plurality of insulation units 7 extend from the perimetric sleeve 1, each of the plurality of insulation units 7 is initially adjusted and then folded towards the outer surface 6. By doing so, the user is provided with thicker holding area.

Although the invention has been explained in relation to its preferred embodiment, it is to be understood that many other possible modifications and variations can be made without departing from the spirit and scope of the invention as hereinafter claimed.

What is claimed is:

1. A disposable cup insulator for use with a cup containing a beverage, the disposable cup insulator comprising:

a perimetric sleeve being ring-shaped to encircle at least a portion of the cup, the perimetric sleeve including:

a first circumferential edge; and a second circumferential edge, when the perimetric sleeve is positioned around the cup, the second circumferential edge being closer to a top portion of the cup than the first circumferential edge and the first circumferential edge being closer to a bottom portion of the cup than the second circumferential edge, the circumference of the perimetric sleeve at the second circumferential edge being larger than the circumference of the perimetric sleeve at the first circumferential edge, the perimetric sleeve having an inner surface and an opposite outer surface, the perimetric sleeve being tapered from the second circumferential edge to the first circumferential edge to be positioned around at least a portion of the cup, the second circumferential edge being positioned opposite to the first circumferential edge across the perimetric sleeve, the inner surface of the perimeter sleeve being adapted to contact the cup; and a plurality of insulation units protruding from the perimetric sleeve and being in a fixed position relative to each other and the perimetric sleeve, the plurality of insulation units being spaced apart from each other and positioned between the second circumferential edge and the first circumferential edge of the perimetric sleeve, each of the plurality of insulation units including:

a first side wall having a height and a width, the first side wall extending from a top portion to a bottom portion of the insulation unit;

a second side wall having a height and a width, the second side wall extending from the top portion to the bottom portion of the insulation unit, the first side wall being positioned opposite to the second side wall across the insulation unit, a distance between the first side wall and the second side wall of the insulation unit being greater than a distance between the inner surface and the outer surface of the perimetric sleeve;

a first face having a length extending from the top portion to the bottom portion of the insulation unit, the first face of the insulation unit being positioned facing the perimetric sleeve;

a second face having a length extending from the top portion to the bottom portion of the insulation unit, the second face being positioned opposite to the first face across the insulation unit, the first face and the second face of the insulation unit connecting to respective sides of the first side wall and the second side wall, the second face of the insulation unit being a curved surface and contacting a hand of the user; and a third face having a length, the third face extending perpendicular to the outer surface of the perimetric sleeve, the length of the third face being less than the length of the first face of the insulation unit, the width of the first side wall and the width of the second side wall decreasing from the third face to the bottom portion of the insulation unit, the width of the first side wall and the width of the second side wall being the widest at the third face of the insulation unit.

2. The disposable cup insulator of claim 1, wherein the curved surface of the second face of each of the plurality of insulation units is convex.

3. The disposable cup insulator of claim 1, wherein the curved surface of the second face of each of the plurality of insulation units is concave.

4. The disposable cup insulator of claim 1, wherein the curved surface of the second face of each of the plurality of insulation units includes a textured surface to provide a gripping surface for the user.

* * * * *